US008443878B2

(12) United States Patent
McCollin

(10) Patent No.: US 8,443,878 B2
(45) Date of Patent: May 21, 2013

(54) DUAL STRIPPER ASSEMBLY FOR SLICK CABLE

(75) Inventor: Chris McCollin, Houston, TX (US)

(73) Assignee: Hunting Energy Services, Inc., Houston, TX (US)

( * ) Notice: Subject to any disclaimer, the term of this patent is extended or adjusted under 35 U.S.C. 154(b) by 449 days.

(21) Appl. No.: 12/777,379

(22) Filed: May 11, 2010

(65) Prior Publication Data

US 2011/0017444 A1 Jan. 27, 2011

Related U.S. Application Data

(60) Provisional application No. 61/227,310, filed on Jul. 21, 2010.

(51) Int. Cl.
*E21B 19/00* (2006.01)
*E21B 33/08* (2006.01)

(52) U.S. Cl.
USPC ..... 166/84.1; 277/330; 166/84.4

(58) Field of Classification Search
USPC ..... 166/84.1, 84.4, 88.1; 277/330
See application file for complete search history.

(56) References Cited

U.S. PATENT DOCUMENTS 1,704,152 A * 3/1929 Stephens et al. ..... 166/83.1
3,013,825 A * 12/1961 Wilson ..... 277/330
3,129,009 A * 4/1964 Simpson ..... 277/330
3,228,703 A * 1/1966 Wilson ..... 277/330
3,468,549 A * 9/1969 Wilson ..... 277/330
3,478,826 A * 11/1969 Barnes ..... 166/301
3,606,347 A * 9/1971 Read et al. ..... 277/317
3,762,725 A * 10/1973 Taylor ..... 277/330
3,831,676 A 8/1974 Brown et al.
4,423,775 A * 1/1984 Wilson ..... 166/84.4
4,476,924 A * 10/1984 Winders et al. ..... 166/84.2
5,361,832 A * 11/1994 Van Winkle ..... 166/84.4
5,566,753 A * 10/1996 Van Winkle et al. ..... 166/84.1
5,636,688 A * 6/1997 Bassinger ..... 166/84.4
5,894,104 A 4/1999 Hedberg
6,000,469 A * 12/1999 Bassinger ..... 166/84.1
6,167,959 B1 * 1/2001 Bassinger et al. ..... 166/84.2
6,439,302 B1 * 8/2002 Wiedemann ..... 166/84.4
6,484,808 B2 * 11/2002 Jones et al. ..... 166/379
6,588,502 B2 * 7/2003 Nice ..... 166/84.4
6,600,108 B1 7/2003 Mydur et al.
6,953,085 B2 * 10/2005 Nice ..... 166/84.4
7,119,283 B1 10/2006 Varkey et al.
7,224,289 B2 * 5/2007 Bausov et al. ..... 340/854.8
7,235,743 B2 * 6/2007 Varkey ..... 174/102 R
7,284,602 B2 * 10/2007 Tessier et al. ..... 166/84.1

(Continued)

*Primary Examiner* — Shane Bomar
*Assistant Examiner* — Wei Wang
(74) *Attorney, Agent, or Firm* — Charles D. Gunter, Jr.

(57) ABSTRACT

The dual stripper device of the invention has a hollow body formed for coaxial connection to the wellhead which provides for unobstructed passage of a slick cable, such as a data transmitting cable which transmits data in real time to the well surface. Disposed coaxially within the hollow body is a resilient wiper element with an internal bore formed along its longitudinal axis for passage of the slick cable. A hydraulically actuated piston applies a compressive force to the wiper element so that a pressure seal is formed between the wiper element and the cable when the wiper element is sufficiently compressed by the piston. The seal can be maintained during dynamic movement of the slick cable through the wiper element. A mirror image backup wiper assembly can be actuated in the case of failure of the first wiper assembly.

7 Claims, 3 Drawing Sheets

U.S. PATENT DOCUMENTS 7,465,876 B2 12/2008 Varkey
7,997,334 B2 * 8/2011 McCorry ..... 166/84.1
2002/0066562 A1 * 6/2002 Nice ..... 166/257
2004/0045735 A1 3/2004 Varkey et al.

* cited by examiner

DUAL STRIPPER ASSEMBLY FOR SLICK CABLE

CROSS-REFERENCE TO RELATED APPLICATION

The present application claims priority from Provisional Application Ser. No. 61/227,310, filed Jul. 21, 2009, entitled "Dual Stripper Assembly for Slick Cable," by the same inventor.

BACKGROUND OF THE INVENTION

1. Field of the Invention

The invention relates generally to the field of well head equipment used in oil and gas well services. More specifically, the present invention relates to an apparatus that provides a pressure seal around a slick cable used in oil field operations.

2. Description of the Prior Art

The use of so called "wireline" conveyance equipment and procedures are well known in the oil and gas industry for running a multitude of different types of well tools and other well equipment in oil and gas wells while the wells are under pressure. For example, in well logging operations, two basic types of wireline conveyance have traditionally been used, slickline and twisted or braided cable. The twisted or braided cable typically consists of a large-diameter cable that mechanically supports a hanging instrument. A wireline truck on the surface will usually be required for support. A data cable of this type supplies power and provides a communication connection down the well to the instrument in the well bore. Slickline, on the other hand, is typically a smaller diameter line in the form of a solid wire on the order of ⅛ inch or smaller, e.g., like piano-wire and does not typically provide real time data at the well surface.

Slickline logging tools have been developed in recent years to enable data collection in deep oil and gas wells. The well casing is completed by setting pipe and grouting it in place with cement. The cement seals the annulus between the soil and the outside diameter of the pipe. The top of the pipe is threaded and a blow-out preventer is installed. Some type sealing device will typically be provided on the upper end of the upper tubing section which will permit the wireline to move into and out of a lubricator while the lubricator is under pressure form the well. A closing valve, such as a gate valve, and a second pipe provide a sealed enclosure above the well head. The sealed enclosure is long enough to accommodate a logging tool with a top sub attached to the slickline cable. The cable exits the lubricator through a sealing gland that enables the slick line to enter the sealed enclosure under pressure. When the gate valve is fully opened, the logging tool descends into the well casing, while the sealing device maintains a seal with the slick line as the hoist lowers the logging tool into the well bore.

Conventional slickline logging tools are designed with internal recording memory to log data during descent and ascent in the hole. After returning from the well, recorded digital data is read out on the surface and chart recordings are used to display the data for analysis. Twisted or braided cable, on the other hand, may provide real time data communication to the well surface. The wireline or cable not only serves to support the tools and other equipment when running them into and withdrawing them from a well, but may also be used to apply forces when manipulating tools and other equipment present in the well.

Depending upon the particular type of equipment present, the sealing device referred to above may take the form of a what is referred to as a stripper, stuffing box, sealing gland, pack-off heads, etc. In each case, the device performs the safety function of pressure containment during wireline operations. For example, wireline (or slick-line) pack off heads (oil savers) have been used by the oil field service industry for many years. A pack off head is designed to make a pressure seal around a wireline to contain the well pressure during trips in and out of the well. If during wireline operations a well kick were experienced, an unsafe condition would occur if the well head was not contained but instead left open to atmosphere. A typical pack off head includes a hard rubber insert with a passage where the wire line passes through the annulus. To seal around the wireline, the hard rubber insert is axially compressed, which reduces the cross sectional area of the passage. Reducing the cross sectional area of the passage causes the inner radius of the passage to fit snugly around the outer radius of the wire line, thus preventing fluid flow through the passage. The typical prior art pack off head only functioned to seal around a static line. This was due at least in part to the fact that the prior art braided cable would quickly destroy the seal if it moved though the energized seal element in use.

Traditionally, pack off heads have been manual or hydraulic. A manual style pack off head is usually comprised of a threaded cap that compresses the rubber packing element as the cap is screwed down onto the head assembly. This operation is typically performed by hand. The hydraulic style pack off head has a hydraulic cylinder that is expanded via hydraulic pressure provided by a hand pump connected to the head by a hydraulic hose. The pack off head hydraulic cylinder moves as pressure is supplied to it, expansion of the pack off head hydraulic cylinder in turn compresses the pack off element to provide a seal around the wireline.

Despite the advances which have been made in the wireline arts, there continues to exist a need for improvements in the area of cable conveyance pressure containment devices of the type discussed above. For example, while slick line or braided cable have been widely used in the past, new types of "slick cable" are now beginning to appear on the scene. The slick cable will have a smooth outer diameter in the same manner as traditional slick line, while allowing real time data communication with the downhole tool in the well bore in the manner of traditional braided cable. Preferably, the new slick cable will be capable of dynamic movement through the seal elements, even when the seal elements are energized to contain well pressure. The outer diameter of these types of slick cable will be much larger than traditional slick line, e.g., larger than ½ inch. New pressure containment devices are needed which have the ability to accept these new types of slick cable.

SUMMARY OF THE INVENTION

The present invention provides a solution to certain of the previously mentioned deficiencies noted in the prior art in the form of a dual stripper assembly which is used in conjunction with a wellhead situated on a hydrocarbon producing well bore, particularly where the assembly is used with a slick cable having a smooth or uniform outer diameter. The assembly allows dynamic stripping of the slick cable through the assembly while the well head is under pressure. The preferred assembly includes a dual isolation end element body having a hollow interior. An isolation sub is received within the hollow interior of the end element body, the isolation sub having an interior bore which communicates each of oppositely arranged upper and lower ends thereof. A cylindrically shaped upper hydraulic cylinder body is mounted on the upper end of the isolation sub and end cap, the upper hydraulic cylinder body having a cylindrically shaped internal piston chamber with a cylindrical upper piston slidably received therein. The upper piston also has a cylindrical interior bore. A cylindrical sleeve member is received within the cylindrical interior bore of the upper piston.

A resilient wiper element is closely received within the cylindrical interior bore of the upper piston, the resilient wiper element having a central bore appropriately sized to receive and seal around a slick cable. The upper element has cylindrical sidewalls and a convex, cone shaped upper extent.

A spring retainer guard including a retaining flange is attached to the upper hydraulic piston for movement upwardly and downwardly with the upper hydraulic piston. A cone shaped wiper retainer is received within the cylindrical sleeve member and has a lower concave extent which contacts and mates with the convex cone shaped upper extent of the resilient wiper element. The upper retainer also has an upper extent which is contained by the spring retainer guard. An externally mounted return spring is received about the exterior sidewalls of the upper hydraulic piston between the spring retainer guard at an upper extent and an upper portion of the hydraulic cylinder at an opposite lower extent.

An upper hydraulic port is connected to a source of hydraulic fluid for communicating hydraulic fluid to an interior region of the upper hydraulic cylinder body for moving the upper hydraulic piston in a downward direction relative to the body. This action, in turn, compresses the return spring and causes the wiper retainer to compress the resilient wiper element, whereby the wiper element seals around a slick cable passing through the central bore thereof.

The preferred assembly also has a second, lower hydraulic cylinder body, lower hydraulic piston and associated resilient wiper element similarly arranged in mirror image fashion on a lower end of the dual isolation end element body for use as a backup in case of failure of the upper wiper element assembly.

In one preferred version of the dual stripper assembly of the invention, the slick cable has a uniform outer diameter, the outer diameter ranging from about 1/8 to about 15/32 inches. The resilient wiper element is made of an elastomer such as rubber and has an outer diameter which is greater than about 2 inches. The wiper element has an interior bore which is sized for the slick cable it will receive, allowing dynamic movement of the slick cable through an energized wiper element. With these dimensions, the assembly of the invention has been tested to hold greater than about 8000 psi pressure in the well bore.

In one version of the assembly of the invention, the lower hydraulic cylinder body houses a velocity check valve which is actuated in the case of an unexpected event such as a cable breaking to isolate well bore pressure. The assembly is also preferably provided with an isolator lock retainer having a pair of internal spline elements which can be installed to lock the dual isolation end element body and the isolation sub to prevent relative vertical movement there between. Removal of the internal spline elements by pulling out a pair of external ears allows the isolation sub, wiper retainers and associated wiper elements to be removed from the assembly for maintenance. Removal of the isolation sub, wiper retainers and associated wiper elements from the dual isolation end element body allows a slick cable with an associated cable head to be pulled freely through the body of the assembly.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
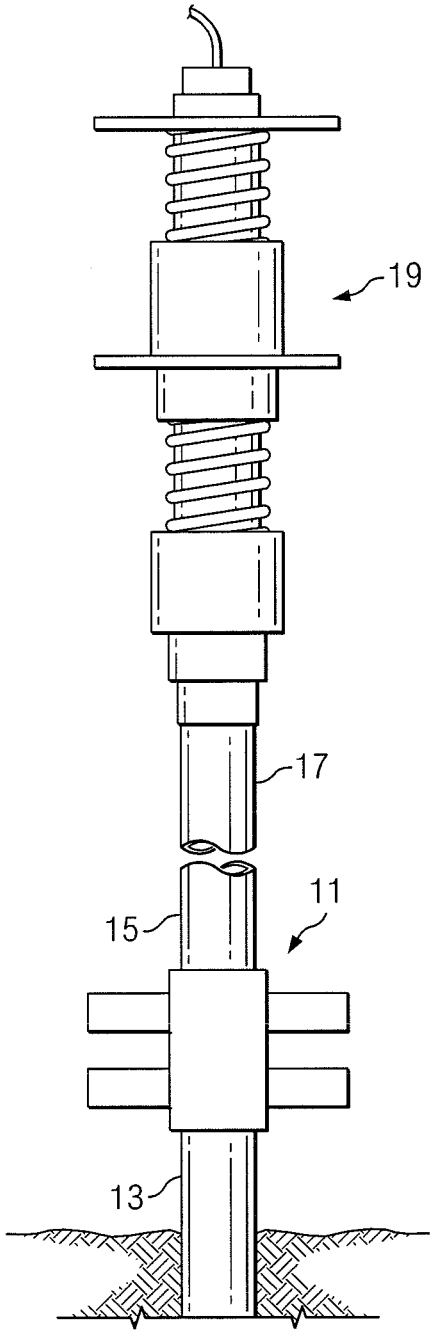
FIG. 1 is a simplified, perspective view of the dual stripper assembly of the invention in place on a well head.

FIG. 1 is a simplified representation of the general environment of the dual stripper assembly of the invention when in use on a well head. A blowout preventer 11 rests atop a wellhead 13. Usually at least two lubricator risers 15, 17 sit atop the blowout preventer 11. The dual stripper assembly 19 of the invention sets atop the lubricator riser 17 and is threadedly connected thereto.

Figure 3:
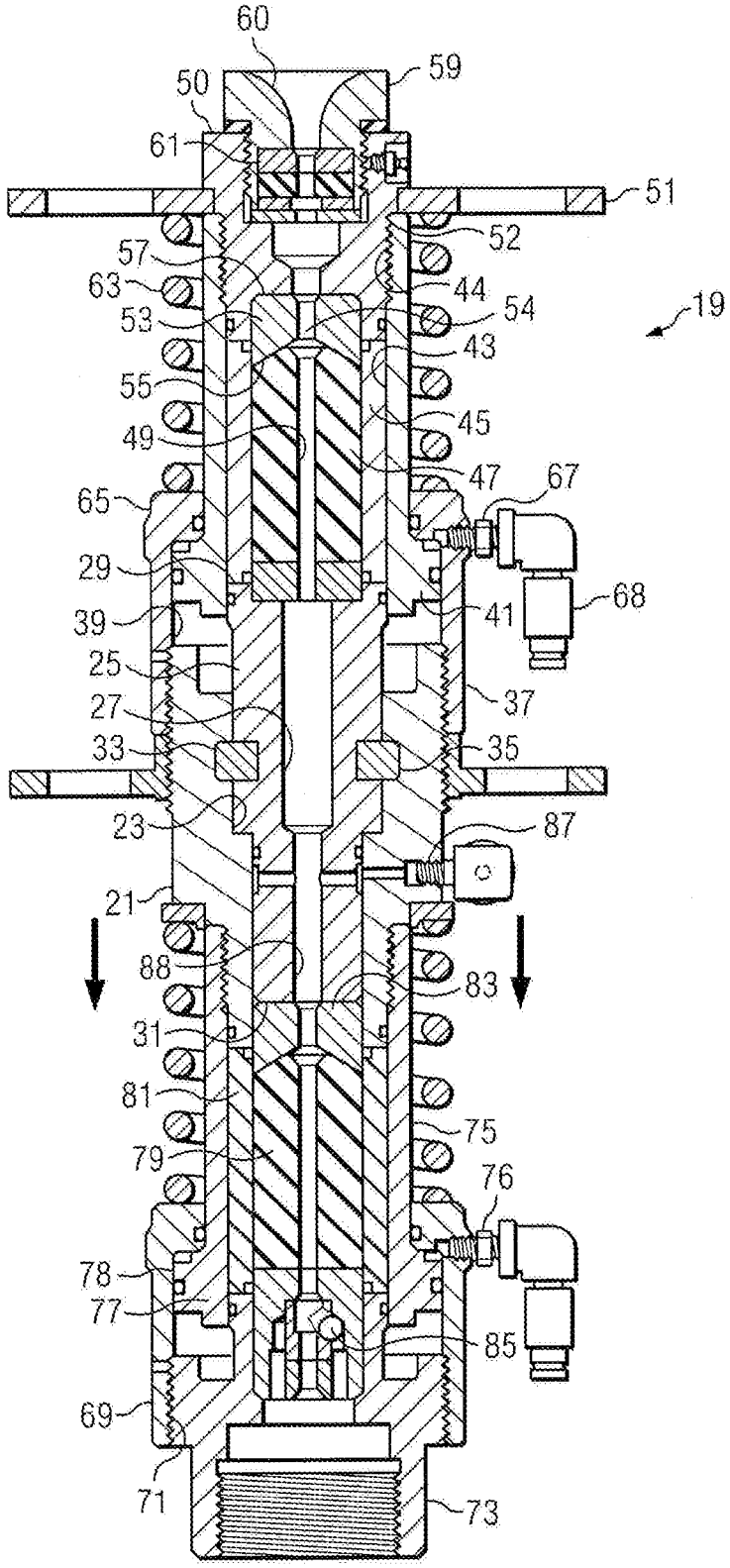
FIG. 3 is a cross sectional view of the assembled dual stripper of the invention showing the operative components thereof.

FIG. 3 is a cross-sectional view of a preferred version of the dual stripper assembly 19 of the invention. The dual stripper assembly 19 includes a dual isolation end element body 21 having a hollow interior 23. The dual isolation end element body 21 has a port 87 which is used to charge an internal reservoir 88 with lubricating grease. An isolation sub 25 is received within the hollow interior 23 of the dual isolation end element 21. The isolation sub 25 has a stepped interior bore 27 which communicates with each of the oppositely arranged upper and lower ends 29, 31 thereof. The exterior of the isolation sub 25 is also stepped and decreases in external diameter between upper and lower generally cylindrical regions thereof.

Figure 2:
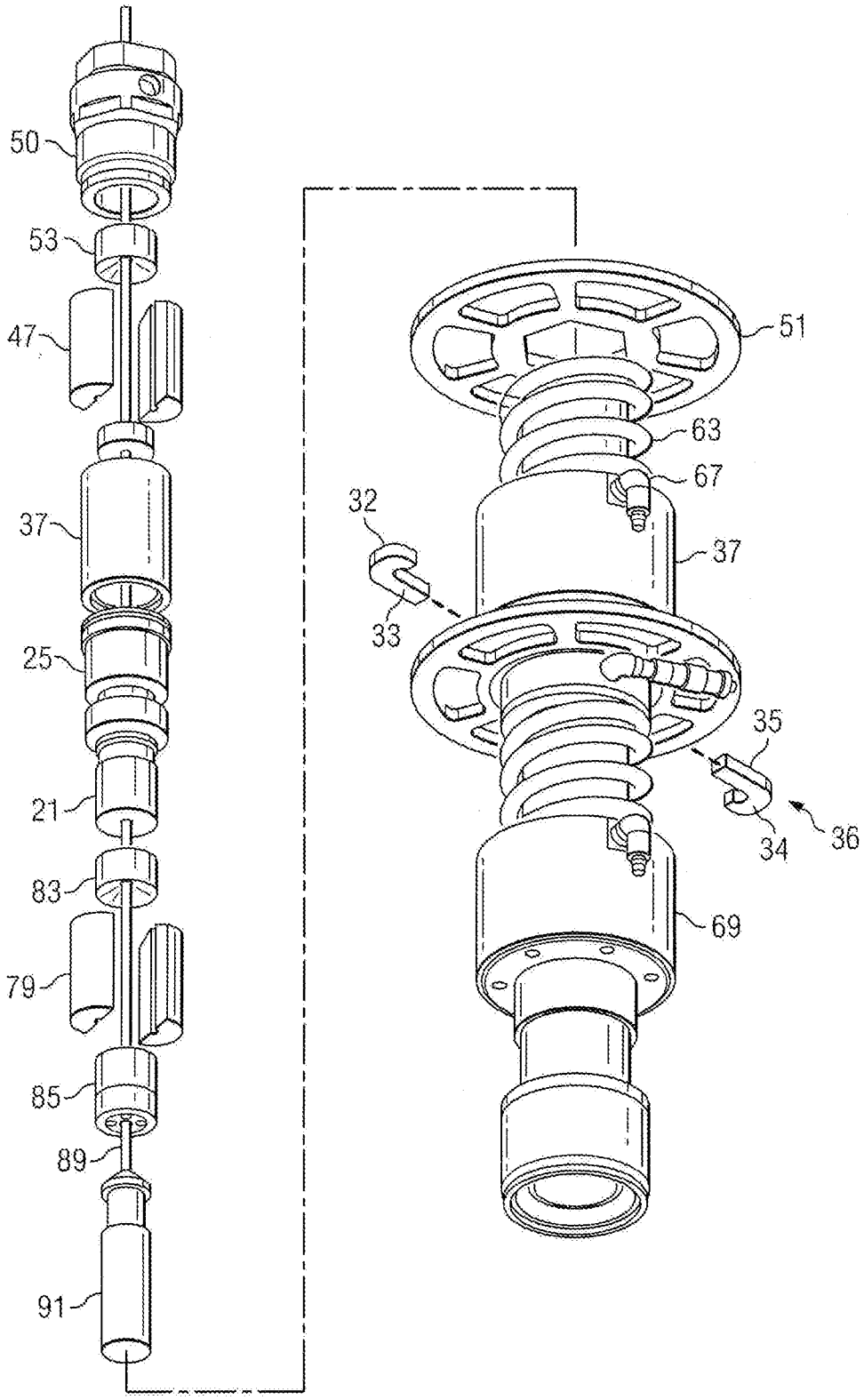
FIG. 2 is an exploded view of the dual stripper of FIG. 1 showing the internal components thereof.

As perhaps best seen in FIGS. 2 and 3, an isolator lock retainer, designated generally as 36 in FIG. 2, comprising a pair of internal spline elements 33, 35 can be installed to lock the dual isolation end element body 21 and the isolation sub 25 to prevent relative vertical movement there between. The spline elements 33, 35 are received in machined recesses provided between the element body 21 and sub 25 and are inserted and removed by means of external ears (32, 24 in FIG. 2).

As best seen in FIG. 3, a cylindrically shaped upper hydraulic cylinder body 37 is mounted on the upper end of the isolation sub 25 and end element body 21. The upper hydraulic cylinder body has a cylindrically shaped internal piston chamber 39 with a cylindrical upper piston 41 slidably received therein. The upper piston 41 also has a cylindrical interior bore 43 and an interior threaded upper extent 44. A cylindrical sleeve member 45 is received within the cylindrical interior bore 43 of the upper piston 41.

A resilient wiper element 47 is closely received within the cylindrical interior bore 43 of the upper piston 41. The resilient wiper element 47 has cylindrical exterior sidewalls and a convex, cone shaped upper extent. The wiper element also has a central bore 49 which is appropriately sized to receive and seal around a slick cable. The upper element 47 will typically be formed of a suitable elastomeric material, such as a suitable rubber. To insure that the wiper element 47 will seal around the slick cable, it is important that the elastomeric material be sufficiently pliable to perform under extreme cold or hot conditions for which it will be used, and yet be of adequate resiliency to sustain the pressure applied to it to preclude leakage between the wiper element 47 and the slick cable.

A spring retainer guard including a retaining flange 51 has an exterior threaded surface 52 which engages the threaded surface 44 of the upper hydraulic piston 41 for movement upwardly and downwardly with the upper hydraulic piston. A wiper retainer 53 is received within the cylindrical sleeve member 45 and has a lower concave extent 55 which contacts an upper mating surface of the resilient wiper element 47. The retainer 53 also has an upper extent 57 which is received within an interior region of the spring retainer guard 50. The retainer 53 has an internal bore 54 which communicates with the central bore 49 of the wiper element 47.

A top guide sub 59 having a central bore 60 is threadedly connected to a top region of the spring retainer 50 and has an interior recess or bore which retains a series of packing materials 61 in the form of disk shaped elements which form a lubrication seal at the upper end of the assembly. The packing elements 61 have central bores which communicate with the bore 49 of the wiper element so that they can receive the slick cable as it passes through the assembly to keep the cable clean as it leaves the assembly.

An externally mounted return spring 63 is mounted about the exterior sidewalls of the upper hydraulic piston 41 between the flange 51 of the spring retainer guard 50 at an upper extent thereof and an upper portion of the hydraulic cylinder 37 at an opposite lower extent. An upper hydraulic port 67 is connected to a source of hydraulic fluid through a conventional fitting 68. The source of hydraulic fluid will typically be a hydraulic hand pump (not shown) present on the rig floor. The port 67 communicates hydraulic fluid from the pressurized source to the upper hydraulic cylinder body 37 for moving the upper hydraulic piston 41 in a downward direction relative to the body, as viewed in FIG. 3. This action serves to compress the return spring 63 and causes the wiper retainer element 53 to compress the resilient wiper element 47 radially inward, whereby the wiper element seals around a slick cable passing through the central bore 49 thereof.

The slick cable (89 in FIG. 2) will generally have a uniform outer diameter which is about ⅛ inch or greater in diameter. Preferably, the slick cable 89 will have a uniform outer diameter which is in the range from about ⅛ to about 15⁄32 inches, unlike the prior art "piano wire" slick wirelines used in the past. The resilient wiper element 47 will have an outer diameter which is greater than about 2 inches. The wiper element 47 is designed to hold at last about 8000 psi pressure in the wellbore and has been tested to 10,000 psi. The slick cable which is capable of being dynamically run through the device will typically have internal communication lines for transmitting data from a tool at a subterranean location in the wellbore in the surface in real time, unlike traditional slick line used in the prior art.

As shown in FIG. 3, the preferred device of the invention will also have a second, lower hydraulic cylinder body, lower hydraulic piston and associated resilient wiper element similarly arranged on a lower end of the dual isolation end cap for use as a backup in case of failure of the upper wiper element assembly. For example, with reference to FIG. 3, the lower hydraulic cylinder body 69 contains a lower hydraulic port 76 and has an internally threaded surface 71 which matingly engages the externally threaded surface of a lower end cap 73. A lower hydraulic piston 75 has a ring-shaped piston portion 77 having a seal ring area 78 which is received within the lower hydraulic cylinder body 69. A lower resilient wiper element 79 is received within the bore of a sleeve member 81, as in the case of the upper wiper element. A wiper retainer 83 rests atop the resilient wiper element 79 and contacts the lower end 31 of the isolation sub 25.

The further details and construction of the lower wiper assembly are generally a mirror image of the upper assembly previously described. However, as shown in FIG. 3, a velocity check valve 85 is located within an internal region of the end cap 73 below the resilient wiper element 79. The velocity check valve 85 has internal passages and a floating check ball which would be actuated in the case of a cable breaking to seal off the relevant internal passages and isolate the wellbore pressure.

With reference now to FIG. 2, the internal components of the device are shown in exploded fashion. It will be appreciated that removal of the internal spline elements 33, 35 allows the isolation sub 25, wiper retainers 53, 83 and associated wiper elements 47, 79 to be removed from the assembly for maintenance. Removal of the isolation sub, wiper retainers and associated wiper elements also allows a slick cable (89 in FIG. 2) within an associated cable head 91 to be pulled freely through the body of the assembly.

With reference again to FIG. 3, the operation of the device will be briefly explained with respect to the upper wiper assembly. In operation, pressure at port 67 forces piston 41 downwardly thereby compressing the wiper retainer and spring retainer to compress the spring 63. The cone shaped wiper retainer 53 presses down on the wiper element 47 causing it to expand radially inwardly toward the slick cable which may be either static or moving dynamically through the wiper element central bore 49. During wireline operations the wiper inner passage (bore 49) will experience some wear due to the dynamic movement of the slick cable 89 through the energized seal (wiper element 47). Although the wear will gradually result in material loss of the inner annulus of the wiper element 47, wiper element will continue to seal against the slick cable because of the constant compressive force applied to it by the wiper retainer 53. When the upper region of the piston 41 is no longer exposed to the hydraulic pressure through the port 67, the spring 63 will return the piston 41 and spring retainer guard 50 to their original positions. The dimensions and characteristics of the spring 63 are determined based on the well parameters. When the spring 63 moves the piston 41 to its original position, the wiper retainer 53 will cease to apply force to the wiper element 47, and therefore no longer compress it.

An invention has been provided with several advantages. The dual stripper of the invention can accommodate slick cable of a larger diameter than the slick wireline used in the past. Unlike the pack off designs of the prior art which only sealed around a static wireline, the dual stripper design of the invention will seal around a dynamically moving slick cable. The slick cable causes less wear and tear on the internal wiper elements and yet allows communication with the downhole tool in real time, if desired. Because the assembly basically features a mirror image of the pack off construction, failure of the upper wiper element can be compensated by actuation of the lower wiper element as a backup measure. The externally mounted return spring and particular sizing of the wiper element and associated components of the assembly make it particularly suited for use with slick cable.

While the invention has been shown in only one of its forms, it is not thus limited but is susceptible to various changes and modifications without departing from the spirit thereof.

What is claimed is:

1. A dual stripper assembly for use with slick cable, the assembly comprising:

a dual isolation end element body having a hollow interior;

an isolation sub received within the hollow interior of the dual isolation end element body, the isolation sub having an interior bore which communicates each of oppositely arranged upper and lower ends thereof;

an upper hydraulic cylinder body mounted on the upper end of the isolation sub and dual isolation end element body, the upper hydraulic cylinder body having a cylindrically shaped internal piston chamber with a cylindrical upper piston slidably received therein, the cylindrical upper piston having a cylindrical interior bore;

a cylindrical sleeve member received within the cylindrical interior bore of the cylindrical upper piston;

a resilient wiper element closely received within the cylindrical interior bore of the cylindrical upper piston, the resilient wiper element having a central bore appropriately sized to receive and seal around a slick cable;

a spring retainer guard including a retaining flange attached to the cylindrical upper piston for movement upwardly and downwardly with the cylindrical upper piston;

a resilient wiper retainer received within the cylindrical sleeve member, the resilient wiper retainer having a cone shaped concave lower extent which contacts a convex mating mating upper surface of the resilient wiper element and having an upper extent which is contained by the spring retainer guard;

a return spring mounted about the cylindrical upper piston between the spring retainer guard at an upper extent and an upper portion of the upper hydraulic cylinder body at an opposite lower extent;

an upper hydraulic port connected to a source of hydraulic fluid, the port communicating hydraulic fluid to the upper hydraulic cylinder body for moving the cylindrical upper piston in a downward direction relative to the upper hydraulic cylinder body, thereby compressing the return spring and causing the resilient wiper retainer to compress the resilient wiper element, whereby the resilient wiper element seals around the slick cable passing through the central bore thereof;

wherein the assembly has a second, lower hydraulic cylinder body, cylindrical lower piston and lower resilient wiper element similarly arranged on a lower end of the dual isolation end element body for use as a backup in case of failure of the upper wiper element; and wherein the assembly further includes an isolator lock retainer comprised of a pair of internal spline elements installed at a location between the upper and lower hydraulic cylinder bodies to lock the dual isolation end element body and the isolation sub to prevent relative vertical movement therebetween the internal spline elements being received in machined recesses provided between the dual isolation end element body and the isolation sub, whereby removal of the internal spline elements allows the isolation sub, resilient wiper retainers and resilient wiper elements to be removed from the dual isolation end element body, leaving the dual isolation end element body extending upwardly from the lower hydraulic cylinder body, removal of the isolation sub, resilient wiper retainers and resilient wiper elements allowing the slick cable with an attached cable head to be pulled freely through the remaining assembly.

2. The dual stripper assembly of claim 1, wherein the resilient wiper element is formed of rubber and has an outer diameter which is greater than about 2 inches.

3. A dual stripper assembly for use with slick cable, the assembly comprising:

a dual isolation end element body having a hollow interior;

an isolation sub received within the hollow interior of the dual isolation end element body, the isolation sub having an interior bore which communicates each of oppositely arranged upper and lower ends thereof;

an upper hydraulic cylinder body mounted on the upper end of the isolation sub and dual isolation end element body, the upper hydraulic cylinder body having a cylindrically shaped internal piston chamber with a cylindrical upper piston slidably received therein, the cylindrical upper piston having a cylindrical interior bore;

a cylindrical sleeve member received within the cylindrical interior bore of the cylindrical upper piston;

a resilient wiper element closely received within the cylindrical interior bore of the cylindrical upper piston, the resilient, wiper element having a central bore appropriately sized to receive and seal around a slick cable;

a spring retainer guard including a retaining flange attached to the cylindrical upper piston for movement upwardly and downwardly with the cylindrical upper piston;

a resilient wiper retainer received within the cylindrical sleeve member, the resilient wiper retainer having a cone shaped concave lower extent which contacts a convex mating mating upper surface of the resilient wiper element and having an upper extent which is contained by the spring retainer guard;

a return spring mounted about the cylindrical upper piston between the spring retainer guard at an upper extent and an upper portion of the upper hydraulic cylinder body at an opposite lower extent;

an upper hydraulic port connected to a source of hydraulic fluid, the port communicating hydraulic fluid to the upper hydraulic cylinder body for moving the cylindrical upper piston in a downward direction relative to the upper hydraulic cylinder body, thereby compressing the return spring and causing the resilient wiper retainer to compress the resilient wiper element, whereby the wiper element seals around the slick cable passing through the central bore thereof; and wherein the assembly has a second, lower hydraulic cylinder body, cylindrical lower piston and lower resilient wiper element similarly arranged on a lower end of the dual isolation end element body for use as a backup in case of failure of the upper wiper element, the cylindrical lower piston having a seal ring area which is received within a sealing bore of a lower hydraulic cylinder body;

a lower hydraulic port connected to a source of hydraulic fluid, the port communicating hydraulic fluid to the lower hydraulic cylinder body for moving the cylindrical lower piston in a downward direction relative to the body, thereby compressing the lower resilient wiper element; and wherein the assembly further includes an isolator lock retainer comprised of a pair of internal spline elements installed at a location between the upper and lower hydraulic cylinder bodies to lock the dual isolation end element body and the isolation sub to prevent relative vertical movement therebetween, the internal spline elements being received in machined recesses provided between the dual isolation end element body and the isolation sub, whereby removal of the spline elements allows the isolation sub, wiper retainers and resilient wiper elements to be removed from the dual isolation end element body, leaving the dual isolation end element body extending upwardly from the lower hydraulic cylinder body, removal of the isolation sub, resilient wiper retainers and resilient wiper elements allowing the slick cable with an attached cable head to be pulled freely through the remaining assembly.

4. The dual stripper assembly of claim 3, wherein the lower hydraulic cylinder body houses a velocity check valve which is actuated in the case of a cable breaking to isolate well bore pressure.

5. The dual stripper assembly of claim 4, wherein the velocity check valve is located within the lower hydraulic cylinder body below the lower resilient wiper element.

6. The dual stripper assembly of claim 5, wherein the assembly has a top guide sub and lubrication seal at an uppermost extent thereof and a lower end cap at a lowermost extent thereof which partly houses the velocity check valve.

7. The dual stripper assembly of claim 6, wherein the dual isolation end element body has a grease reservoir injection port provided therein for injecting lubricating grease into the interior bore of the isolation sub.

* * * * *